US005544926A

United States Patent [19]

Ravencroft

[11] Patent Number: 5,544,926

[45] Date of Patent: Aug. 13, 1996

[54] SHAFT GRIPPER FOR PULLING AN ARROW

[76] Inventor: Gary N. Ravencroft, 5011 Ravelle Ct., Paradise, Calif. 95969

[21] Appl. No.: 432,368

[22] Filed: Apr. 24, 1995

Related U.S. Application Data

[63] Continuation-in-part of Ser. No. 34,196, Jan. 30, 1995.

[51] Int. Cl.[6] ..... B25B 9/00

[52] U.S. Cl. ..... 294/1.1; 294/99.1

[58] Field of Search ..... 294/1.1, 15, 25, 294/99.1, 99.2, 33, 171; 29/278; 188/65.1, 65.2; D9/434; 25/115 R, 129 R, 130, 129 D

[56] References Cited

U.S. PATENT DOCUMENTS

| | | | |
|---|---|---|---|
| 263,775 | 9/1882 | Emmert | 188/65.1 |
| D. 328,187 | 7/1992 | Saurette | 294/171 |
| 675,788 | 6/1901 | Oakley | 188/65.1 |
| 2,301,843 | 11/1942 | Abdella | 188/65.1 |
| 2,444,558 | 7/1948 | Elliott . | |
| 2,448,894 | 7/1948 | Laus . | |
| 3,072,955 | 1/1963 | Mitchell . | |
| 3,149,367 | 9/1964 | Dills | 294/171 |
| 3,682,023 | 8/1972 | Green, Jr. . | |
| 3,873,068 | 3/1975 | Allen | 294/26 |
| 3,890,692 | 6/1975 | Jandura, Jr. | 294/15 |
| 4,523,781 | 6/1985 | Brody | 294/1.1 |
| 4,787,660 | 11/1988 | Mrazek | 294/1.1 |
| 4,829,999 | 5/1989 | Auth | 24/115 R |
| 5,364,148 | 11/1994 | Bartocci | 294/171 |

*Primary Examiner*—Dean Kramer

[57] ABSTRACT

An elongated resilient grip member having a longitudinal V-shaped groove formed therein. In length, the grip is normally about the width of a hand, but could be longer, and the lengthwise V-shaped groove is of sufficient size for placement over an arrow shaft. The grip is preferably manufactured of a stiff yet somewhat flexible rubbery material which is sufficiently flexible to mold about and frictionally adhere to the majority of the surface of the arrow shaft when the exterior of the grip is grasped firmly and squeezed by the hand of a user. The V-shaped groove is defined by convergent side walls which are substantially taller or wider than the diameter of an arrow shaft. The arrow shaft fits within the relatively deep V-shaped groove near a bottom hinge-like portion thereof to leave a substantial length of the convergent side walls extending outward beyond the arrow shaft. The V-shaped groove defined by the convergent side walls defines a wide-mouth V-slot, and the extending portions of the convergent side walls beyond the gripped arrow shaft in combination with the wide-mouth of the groove allows the extending portions of the convergent side walls to be squeezed inward to serve as levers or leverage providing extensions beyond the arrow shaft. The arrow shaft serves as a fulcrum functional in conjunction with the leverage-providing extensions during the squeezing and pulling process.

3 Claims, 7 Drawing Sheets

SHAFT GRIPPER FOR PULLING AN ARROW

This complete original utility application is a 37 C.F.R. 153 Continuation-In-Part of my Design patent application Ser. No. 29/034,196 filed Jan. 30, 1995 of which the benefit of the earlier filing date for the common material is claimed.

BACKGROUND OF THE INVENTION

1. Field of the Invention

This invention generally relates to gripping devices, and more precisely to a small hand-held flexible and resilient grip structured for assisting in the manual pulling of an arrow from a target.

2. Description of Prior Art

Sometimes arrows are embedded into targets sufficiently so that it is extremely difficult to pull them out by hand. The primary problem is in getting a good grip on the arrow shaft without the hands slipping, and often not in providing sufficient pulling pressure. Pulling arrows is a particular problem with the increasingly popular three dimensional animal targets now being used. These life sized 3-Dimensional targets are made of a rigid urethane foam which are structured to appear like live animals such as deer, elk or small animals such as squirrels. The increased power produced by compound bows also embeds the arrows deeper into the target, making the arrows even more difficult to pull out.

Archers and hunters often use a frictionally adhesive piece of flat sheet material, such as synthetic rubber or plastic, to help provide a better grip over the arrow shaft. However, the surface area over the shaft is still very small for the hand to grasp and the person cannot get a good hold. Excessive gripping or squeezing strength is still therefore required to remove the arrow from the target.

Although there have been devices provided in the past for assisting in pulling arrows from targets such as the rubbery flat sheet material mentioned above, they are not structured similar to the present invention and none function as well. There do exist however, handles or grips which are pertinent to the present invention but are structured differently and intended for completely different purposes. These prior art devices are provided primarily as handles for carrying articles or as aids in manipulating tools of some sort. One such hand grip is provided as a turnbuckle wrench which is described in U.S. Pat. No. 3,682,023, issued to Greene, Jr. on Aug. 8, 1972. Greene's device discloses a small cylindrical slotted body having the interior of the groove structured to receive a turnbuckle link. The groove is defined by parallel side walls. The exterior of the cylinder is grasped by the user and rotated to tighten the turnbuckle. The interior of the groove of this prior art device is rigid in structure and designed for receiving a turnbuckle and would therefore not be sufficiently resilient to conform around and grasp the exterior surface of the arrow shaft.

Another device structured for supporting articles is provided in a U.S. Pat. No. 2,444,558, issued to Elliott on Jul. 6, 1948 for a service handle. Elliott's handle is structured of a small hollow cylindrical member, generally rigid or semi rigid in structure, which contains a longitudinal groove sized for passage over cord handles of shopping bags. This device serves to protect the person's hand from cutting or abrading by the cords.

A hand grip is taught in U.S. Pat. No. 3,072,955, granted to Mitchell on Jan. 15, 1963, for fitting over cord handles, bucket wire handles and any other narrow diameter handles which have proved difficult for the person to carry or hold. Mitchell's device includes a small hand held hollow tubular member having an elongated groove along one side opening into the hollow interior. The interior wall of the hand grip is structured of a plurality of spaced parallel longitudinal ribs alternating with parallel longitudinal grooves, which serve as a gripping surface for engagement with narrow handles. Since the interior diameter of the hand grip is comparatively large in comparison with the side opening, this device would also not be of great benefit for use in pulling arrows from targets.

Another gripping member is taught in U.S. Pat. No. 2,448,894, issued to Laus on Sep. 7, 1948 for a shopping bag handle. Laus' device is structured of an elongated member roughly egg shaped in cross-section, which is sized for holding in the palm of the hand. The narrower upper lengthwise edge of the handle contains a lengthwise groove which divides on the bottom end into two lengthwise grooves. Each lower divided groove is sized for insertion over the cord handles found on shopping bags. Laus's handle serves to distribute the load of the cord handles over a wider area, which is much more comfortable for the carrier. While it appears the lengthwise groove of the Laus device could conceivably be manually spread open sufficiently to receive the arrow shaft, this would require the use of two hands which is cumbersome and more time consuming.

Therefore, there is a need to provide an easily portable device for aiding archers in the removal of embedded arrows from a target.

SUMMARY OF THE INVENTION

The following detailed description is of preferred structures and best modes for carrying out the invention. For the sake of briefness of this disclosure, many changes to the described structures which fall within the scope of the present invention have not herein been detailed.

The present invention is an elongated resilient grip member having a longitudinal V-shaped groove in a side of the body of the grip member. In length, the body of the grip or gripper member is normally about the width of a hand, and the lengthwise V-shaped groove is sized for placement over an arrow shaft. The grip is manufactured of a stiff yet somewhat flexible rubbery material which contacts the surface of the arrow shaft and is sufficiently flexible to mold about and frictionally adhere to the majority of the surface of the arrow shaft when the cylindrical exterior of the grip is grasped firmly and squeezed by the hand of a user. The V-shaped groove is defined by convergent side walls facing one another and which are substantially taller than the diameter of an arrow shaft. The arrow shaft fits within the relatively deep V-shaped groove near a bottom hinge-like portion thereof to leave a substantial length of the convergent side walls extending outward beyond the arrow shaft. The V-shaped groove defined by the convergent side walls defines a wide-mouth V-groove or slot, and the extending portions of the convergent side walls facing one another beyond the gripped arrow shaft in combination with the wide-mouth of the groove allows the extending portions of the convergent side walls to be squeezed inward to serve as levers or leverage providing extensions beyond the arrow shaft. The arrow shaft serves as a fulcrum functional in conjunction with the leverage-providing extensions during the squeezing and pulling process. A much lesser degree of squeezing strength is therefore required by the user to remove an arrow from a target. When the present grip is applied to an arrow shaft and squeezed, the grip will not slide along the arrow, thereby whatever pulling pressure is applied to the grip is fully applied to the arrow shaft which will allow the pulling of the arrow from the target.

The preferred length of the grip is approximately three and a half inches or the width of the hand as previously mentioned, and the exterior diameter of the grip is about one and one half inch, or large enough in diameter to grasp in the palm of the hand with your thumb wrapped in one direction and your fingers wrapped in the opposite direction so that the two side walls of the V-shaped groove may be squeezed inward. This size has been found to work sufficiently well within a given range of hand sizes. The basic size requirement of the grip is that it be sufficiently large in length and exterior diameter to allow the user to get a firm hold on the grip member. If the diameter of the grip member were too small, there would not be sufficient surface area contact by the interior surface of the user's hand with the exterior surface of the grip to provide enough frictional contact or to properly function with the palm, thumb and fingers in the squeezing process.

The longitudinal V-shaped groove opens through the exterior surface of the body of the grip wherein the wide-mouth opening is defined in the exterior side wall and the V-groove narrows as it extends toward the center of the gripper member. The groove extends lengthwise the full length of the grip, extending lengthwise through the two oppositely disposed terminal ends of the grip, and is sized for fitting over the shafts of all conventional makes and models of arrows. The smallest arrow shafts are about ⅛ inch in diameter and sometimes a little smaller, with the largest arrow shafts reaching about ⅜ of an inch and sometimes a little larger. The V-shaped groove is approximately five eights inch wide at the wide open mouth on the exterior surface of the member, and narrows down the converging side walls to a closed bottom of the "V" around one sixteenth of an inch wide. Therefore, the V-groove or slot is of the correct size for any given arrow shaft since the shaft will at some point bottom out or contact both of the convergent side walls of the groove, sometime higher and sometimes lower within the groove depending upon the diameter of the arrow shaft. The arrow shaft is placed in lengthwise parallel alignment with the length of the V-groove in the main body of the gripper member. Once the arrow shaft is placed into the groove, the user simply closes his hand tightly over the exterior of the grip and squeezes, which closes the groove tightly onto the arrow shaft. The V-shaped groove is sufficiently large that it essentially divides the grip into two halves which basically function similar to a vise. This vise-like function is aided by the hinge-like area between the bottom of the groove and the exterior surface of the grip directly beneath the hinge. Since the material of the grip is flexible, this hinge-like area bends easily. As the user's fingers and thumb tighten over the open V-shaped groove, the finger on one side and the thumb on the other side of the groove, the convergent side walls are drawn together, being allowed to be drawn together due to the wide mouth opening of the V-shaped groove, to very tightly pinch the arrow shaft. The side walls extend a significant distance upward past the arrow shaft which aids in the leverage or clamping pressure applied against it. Therefore, a tremendous amount of clamping pressure is exerted on the arrow shaft by a relatively moderate hand gripping force. In essence, the squeezing force of the user is greatly increased, as the depth of the V-groove is preferably two to three times that of the diameter of the larger sized arrow shafts for good leverage gain, and thus the shaft gripper will not slip on the arrow shaft because it is a high leverage clamping device. Since the gripper is fairly large in external diameter, the hand of the user is not likely to slip off of the grip. Once the arrow shaft is securely gripped in the gripper, pulling pressure can be applied to withdraw the arrow from the target.

The material of which the grip is manufactured is preferably rubbery material, such as a 40 durometer natural gum rubber for example, and is preferably one single material made in an integral molding process such as by extrusion, pultrusion or injection molding so the gripper made be made inexpensively. The material is resilient so as to automatically open the wide mouth of the V-groove upon release of pressure, but flexible enough to be easily squeezed by hand onto an arrow, and stiff to a sufficient degree so as to allow the extending portions beyond the arrow shaft to serve as levers, and many natural and synthetic rubbery materials can be used to make the present gripper member. The material must be sufficiently resilient or pliable to conform to or contact the majority of the exterior surface of the arrow shaft, yet the side wall thickness must be sufficient to maintain a minimum overall exterior diameter of the gripper when compressed for providing and maintaining sufficient surface area contact for the hand.

Therefore, the combined features of the greater surface area contact by the hand to the grip, the greater surface area contact to the arrow shaft by the grip, the frictionally adhesive qualities of the rubbery material, the resiliency of the material, and the vise-like quality of the grip due to the convergent side walls and provided leverage gain from the extending portions of the gripper beyond the gripped arrow shaft all serve to provide the user with ease in removing an arrow from a target.

Although the grip has been suggested as cylindrical in profile, other shapes such as octagonal or even V-shaped, can also be used as long as the exterior of the grip provides sufficient surface contact for the user's hand. One alternative embodiment of the grip includes finger ridges molded onto the exterior for possible added by the hand. Another embodiment of the invention is anticipated for a two handed operation, simply being the above described grip only made long enough to be gripped by two or both hands at once, one in front of the other on the same long gripper. If the arrow were securely embedded in the target to the point that two hands were needed to free it, then a two handed embodiment of the invention would be provided wherein the length of the grip would be sufficient for gripping with two hands. The grip may also be provided in a variety of colors, and a carrying pouch or attachment hook attachable to a belt may also be provided as an accessory item.

BEST MODES OF CARRYING OUT THE INVENTION

Figure 1:
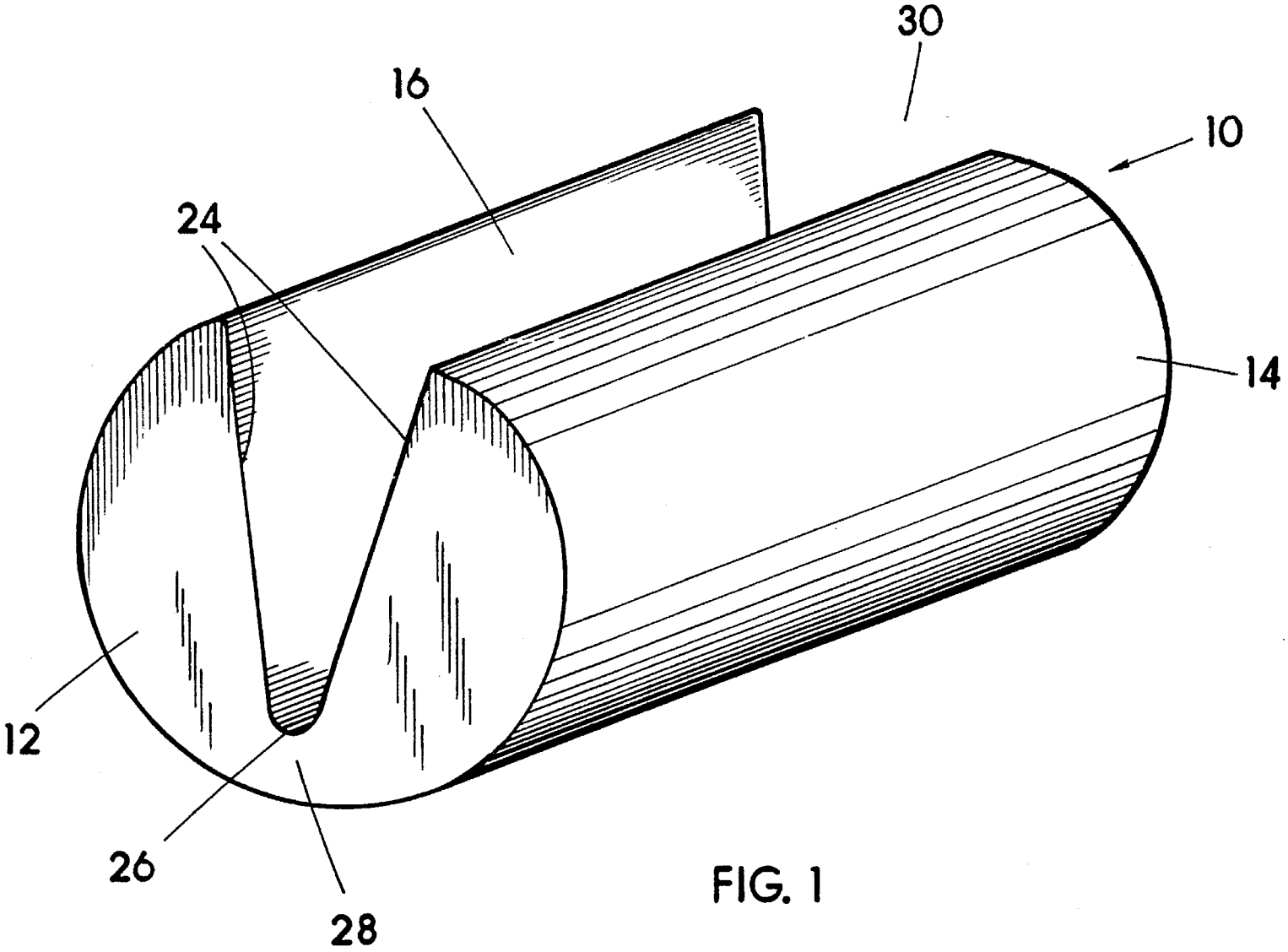
FIG. 1 is a perspective top view of a first embodiment of an arrow shaft gripper for pulling arrows in accordance with the present invention.
Figure 2:
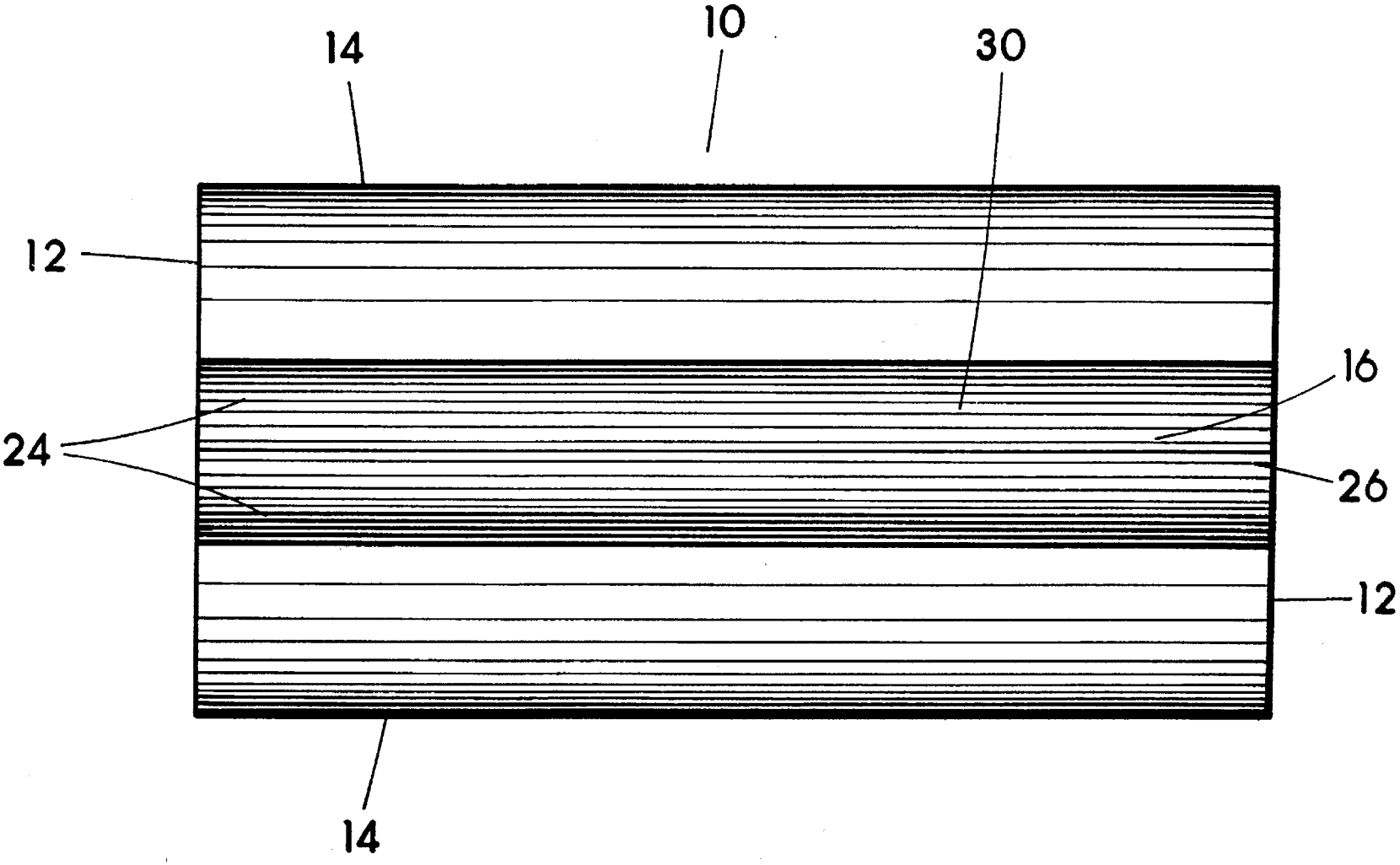
FIG. 2 is a top plan view of that shown in FIG. 1.
Figure 3:
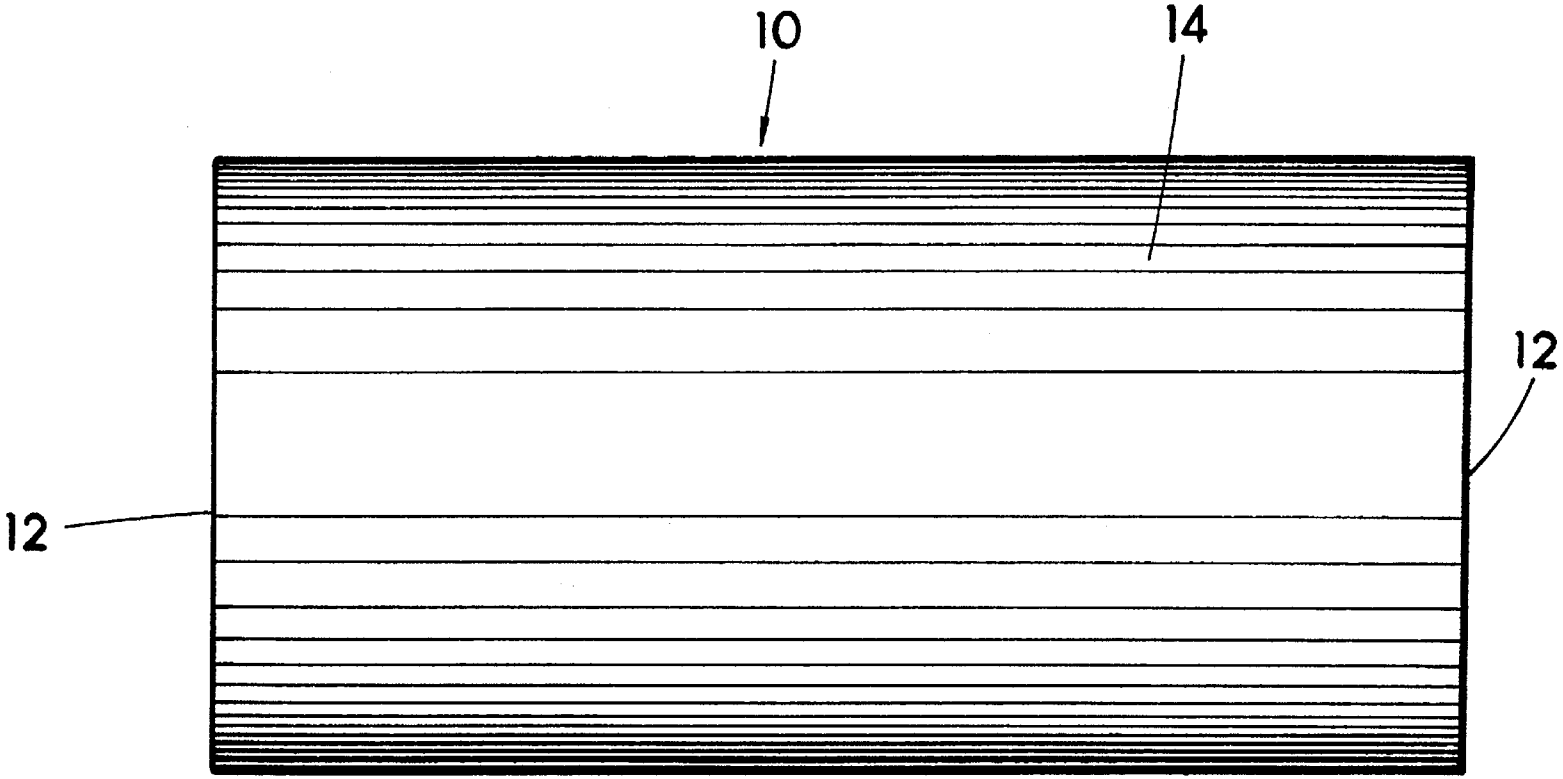
FIG. 3 is a bottom plan view of that shown in FIG. 1.
Figure 4:
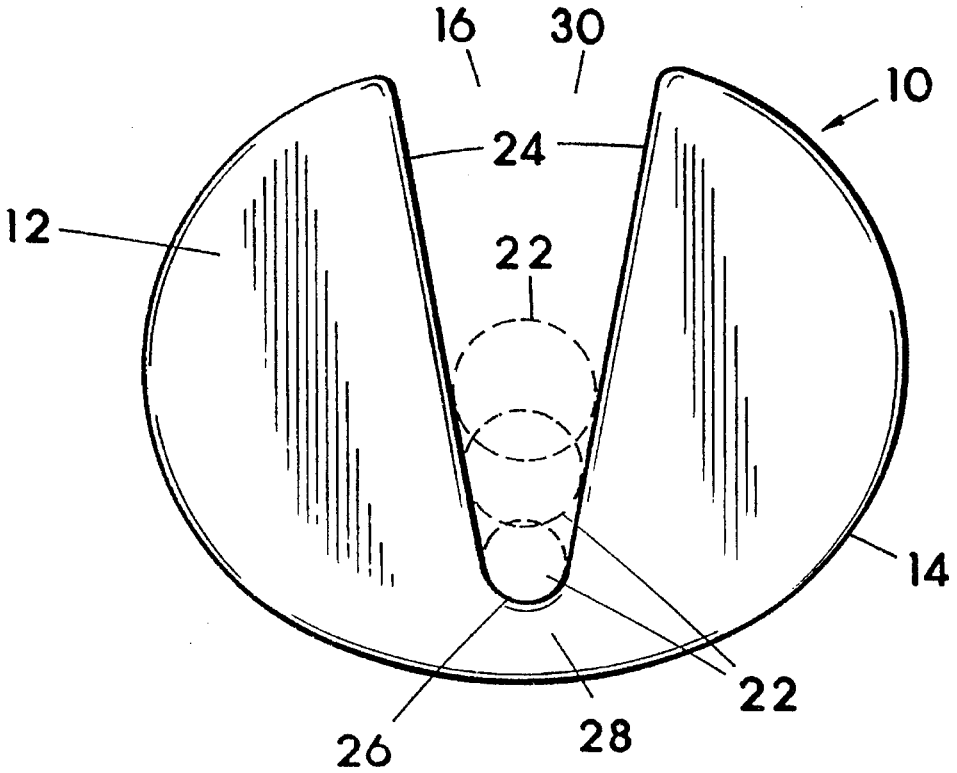
FIG. 4 is an end view of the shaft gripper of FIG. 1 showing the relative placement of the three most common sizes of arrows shown in broken lines.
Figure 5:
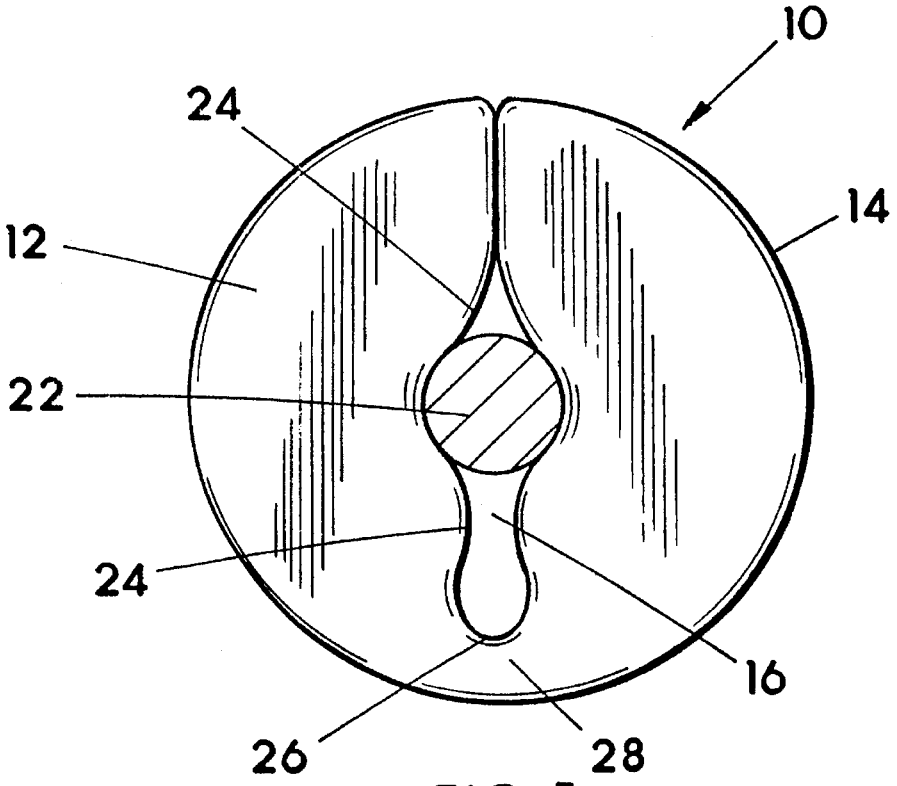
FIG. 5 illustrates an end view of the shaft gripper of FIG. 1 being compressed over an arrow.

It should be noted that various changes and alterations, other than those specifically described and illustrated, in the specific structure of the present invention may be clearly made within the bounds of the scope of the appended claims.

Referring now to the drawings where hand grip 10 (gripper member) is illustrated. Hand grip 10 includes an elongated body having two vertical or straight-cut end walls 12, an exterior wall 14 which may be of various shaped as illustrated in the many included drawings, and a longitudinal V-shaped groove 16 extending from one end wall 12 to the opposite end wall 12. Hand grip 10 is preferably about three and one half inches in length and one and one half inches in diameter, or of a size suitable for holding in the palm of a person's hand 18 as previously mentioned. Some variations in size may be made to accommodate differences in hand sizes although it has been found the preferred size accommodates the majority of hand sizes of those involved in the sport of archery.

The longitudinal V-shaped groove 16 has convergent planar side walls 24 facing one another which extend from the exterior wall 14 of hand grip 10 and angle downward and converge at a closed bottom end 26 of groove 16 adjacent the opposite side of exterior wall 14, with just a small section of material left to form living hinge 28 as shown in FIG. 1. The open top end 30 of groove 16 is approximately five eights inch in width and each side wall 24, which are shown as planar, is positioned about ten degrees from vertical, although I do not wish to be strictly restricted to these degrees and sizes given for example. Side walls 24 are shown and described as planar, as this is a shaped easily manufactured and which functions well, but the surface of the side walls 24 could be dimpled, convoluted, or made having small fingers or bumps and still remain within the scope of the present invention. Likewise there is no significant reason other than ease in manufacturing as to require end walls 12 to be square cut as opposed to being cut at a slight angle or slope. The two combined side walls 24 form about a twenty degree angle. This size of groove 16 has been found to effectively accommodate all the conventionally sized diameters of shafts 20 of arrows 22 currently being used. The smaller diameter arrows 22 are approximately one eighth of an inch in diameter, and generally fit near the bottom end 26 of groove 16. The larger size arrows 22 are about ⅜ of an inch in diameter, and will engage side walls 24 of groove 16 about mid way. The intermediate sized arrows 22 will engage side walls 24 in between the middle and bottom end 26 of groove 16, or a little closer to the bottom end 26 than a larger arrow shaft. There is a significant amount of the side walls 24 extending upward beyond the engagement of even the largest arrows 22, therefore side walls 24 act as levers with shaft 20 acting as the fulcrum. Therefore, when the user places hand grip 10 over shaft 20 of arrow 22 and compresses or squeezes grip 10 tightly, the upper or outer ends of side walls 24 adjacent open end 30 are drawn together and pivot on hinge 28, thus clamping tightly over shaft 20 of arrow 16. The leverage action is more significant when the hand grip 10 is positioned with open top end 30 positioned away from the palm of hand 18, so that the fingers of hand 18 direct the force over the upper ends of side walls 24. However, hand grip 10 also works well with groove 16 positioned anywhere within hand 18 since hand grip 10 is small enough in diameter to allow hand 18 to completely or almost completely grip over exterior wall 14. This in effect directs the force applied by hand 18 to be applied almost unilaterally or equally to a given circumferential point on exterior wall 14.

Hand grip 10 is manufactured of a soft, semi-flexible, moderately resilient material such as 40 durometer natural rubber for example. Other suitable materials, such as rubber-like plastics or elastomers may also be used. The material of which hand grip 10 is manufactured is also pliable enough to conform to a majority of the surface of shaft 20 when clamped between side walls 24, and this allows a greater surface area of shaft 20 to be in contact with side walls 24, which provides greater area contact with the frictionally adhesive material of which hand grip 10 is manufactured. I have considered forming the body of the gripper member of one rubbery material and lining the V-shaped groove with a second perhaps more frictionally adhesive thin soft rubbery sheet glued in place, but this is more expensive to manufacture, and the gripper member can be made inexpensively with one single material integrally molded which will function well for pulling arrows.

To remove arrow 22 from a target the user places hand grip 10 in the palm of hand 18, preferably with hinge 28 adjacent the palm. V-shaped groove 16 is then inserted over shaft 20 of the imbedded arrow 22 until shaft 20 engages side walls 24. The user then squeezes hand grip 10 and compresses exterior wall 14 enough to reduce the angle between side walls 24 at least to the point side walls 24 engage around the majority of shaft 20. The user then pulls grip 10 and arrow 22 in an opposite trajectory to which it struck the target, thereby removing arrow 22 from the target. The user may use the other hand for bracing against the target if needed. Hand grip 10 can then be easily removed from shaft 20 by releasing hand 18 hold. Grip 10 can then be placed in the archer's pocket or otherwise stored for later use. Since grip 10 is small and light weight it can easily be carried in a pocket or backpack or even attached to a belt by a tether.

Figure 6:
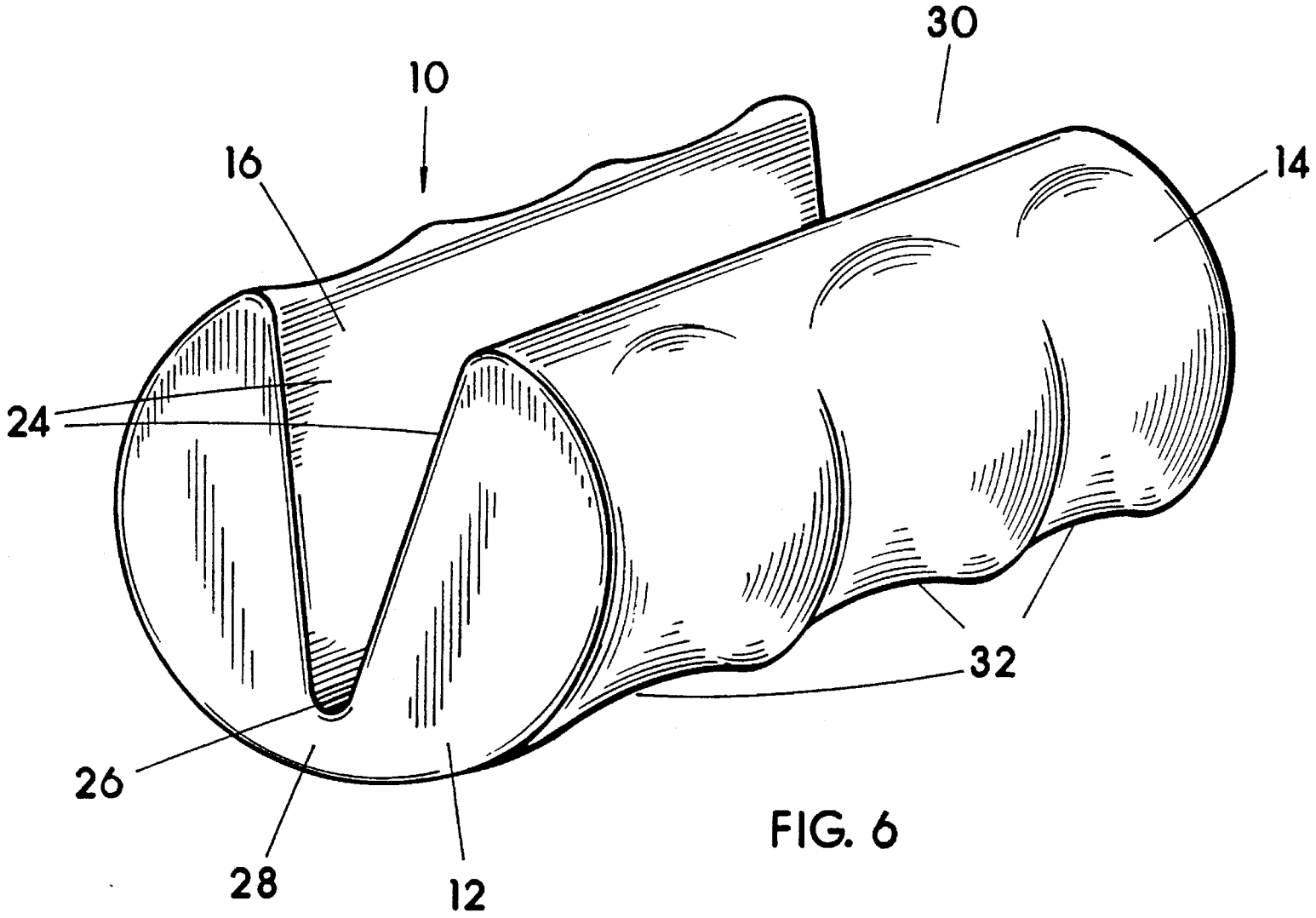
FIG. 6 is a top perspective view of a second embodiment in accordance with the invention showing the exterior wall molded with finger grips or ridges to help prevent hand slippage.
Figure 7:
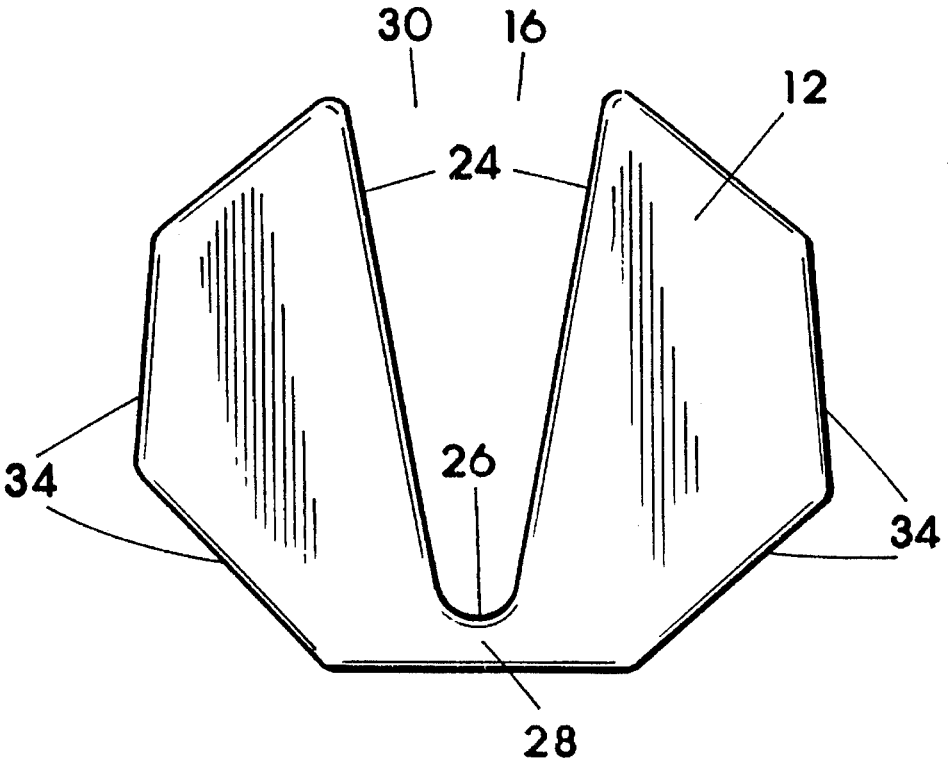
FIG. 7 is an end view of a third embodiment in accordance with the invention showing an alternative exterior wall shape which might provide good anti-slip qualities.
Figure 8:
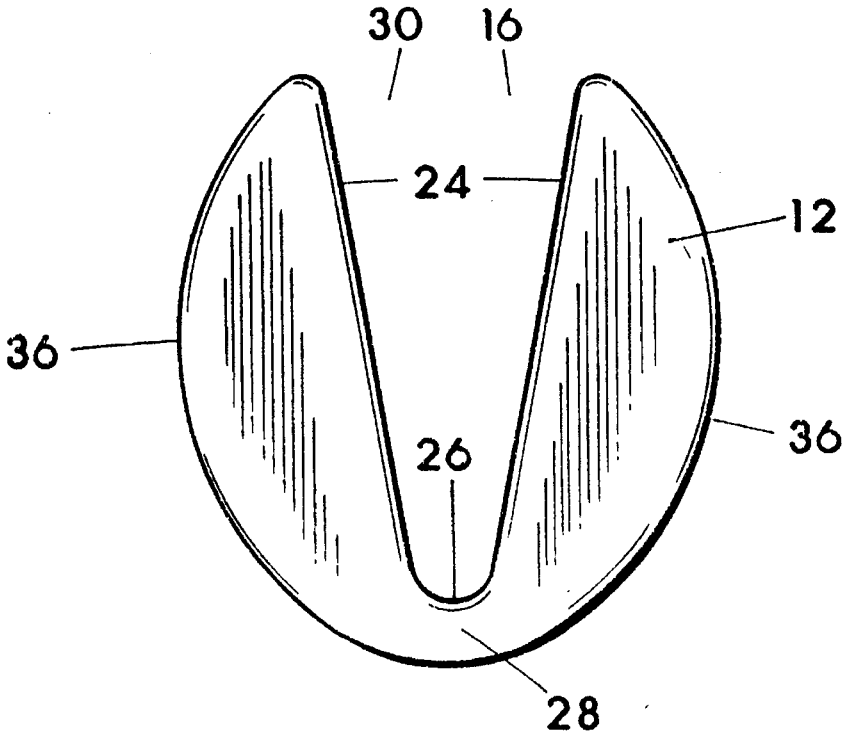
FIG. 8 is an end view of a forth embodiment in accordance with the invention showing another alternative exterior wall shape which might function well while requiring less rubbery material to manufacture.
Figure 9:
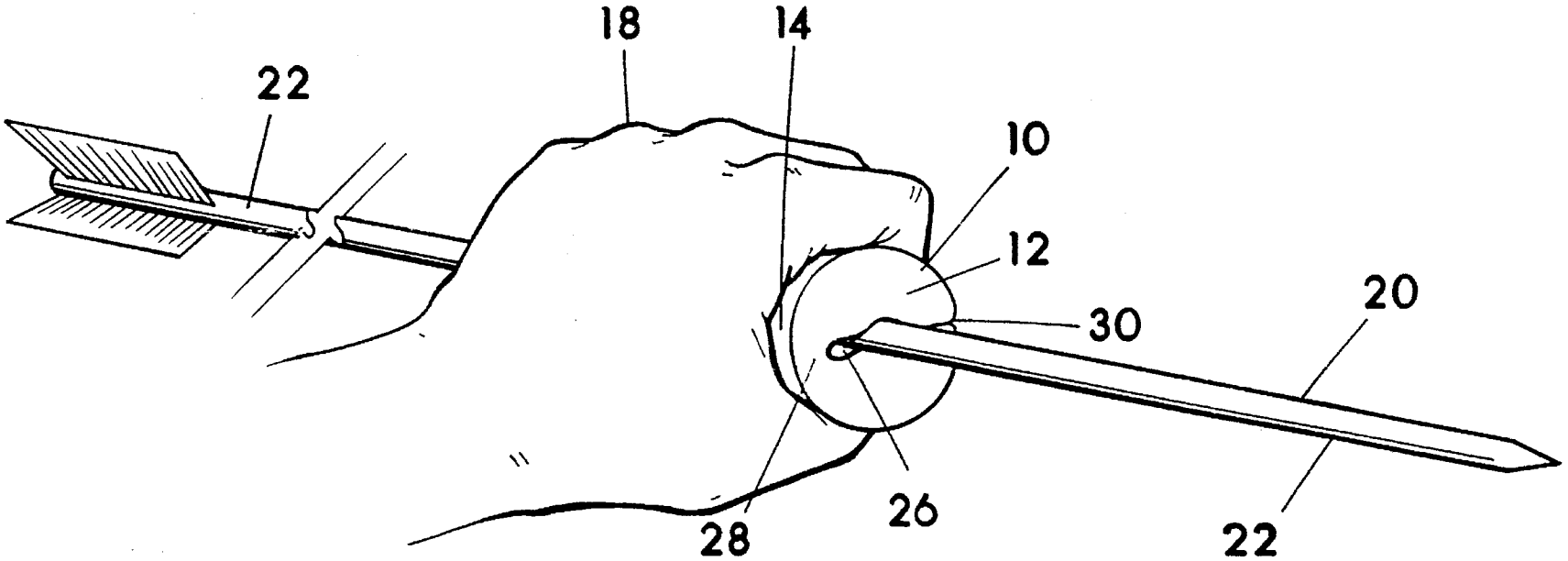
FIG. 9 illustrates a human hand gripping an arrow using the hand grip of the first embodiment of FIG. 1. The shown arrow has just been pulled from a target, the target is not shown.

Although the diameter of hand grip 10 should be maintained within a given size range to be compatible with the majority of human hand sizes, the specific shape or structure of exterior wall 14 does not have to be cylindrical for proper functioning. Variations in the shape of exterior wall 14 can include ridges or finger grips 32 as shown in FIG. 6. The undulations of finger grips 32 may provide slightly better grip for hand 18. Other variations in exterior wall 14 of hand grip 10 are shown in FIGS. 7 and 8 and include octagonal side wall 34 and oval side wall 36. Octagonal side wall 34 also provides ridges which may increase grippability. Oval side wall 36 reduces the amount of material required to manufacture each grip 10, thereby reducing costs. Other variations in the shape of side wall 14 are also anticipated within the parameters of the structural requirements for proper functioning of hand grip 10.

Although I have very specifically described the preferred structures and use of the invention, it should be understood that changes in the specific structures described and shown in my drawings may clearly be made without departing from the true scope of the invention in accordance with the appended claims.

What I claim as my invention:

1. A hand operated gripper member providing leveraged squeezing pressure gain for use in gripping an arrow shaft of an arrow during pulling of the arrow from a target, said gripper member comprising:

an elongated main body having an exterior surface for grasping in a human hand with said main body placed against the palm of the hand with the fingers and thumb of the hand wrapping about said main body so that said main body may be tightly squeezed by the hand;

said main body having a deep longitudinal groove defined by a first and a second convergent side wall each facing one another, the first and second convergent side walls each beginning at said exterior surface in spaced relationship to one another and defining a wide open mouth of said groove, the first and second convergent side walls extending inward of said main body toward one another and a narrow closed bottom end of said groove adjacent a hinge portion of said exterior surface connecting the first and second convergent side walls to one another;

said groove extending from a first terminal end of said main body through said main body and through a second terminal end of said main body;

said wide open mouth and a substantial depth of said groove downward toward said narrow closed bottom end each of sufficient width for accepting an arrow shaft lengthwise aligned with said groove so that an arrow shaft can be inserted through said wide open mouth and positioned deeply within said groove;

said hinge portion of said exterior surface being flexible and resilient material connecting the convergent side walls to one another and serving as a resilient hinge structured to hold said wide open mouth normally open, and allowing the convergent side walls to be brought inward toward one another to narrow the width of said groove with applied inward squeezing pressure against said exterior surface of said main body;

said groove of sufficient depth and width relative to an arrow shaft to allow for placing an arrow shaft within said groove with the arrow shaft positioned sufficiently deep within said groove and away from said wide open mouth as to leave extending lever portions of the convergent side walls outward beyond an inserted arrow shaft toward said wide open mouth;

said extending lever portions having a degree of stiffness sufficient to be operable in combination with said wide open mouth being sufficiently wide open when an arrow shaft is positioned within said groove that upon squeezing of said main body by hand with pressure applied to said exterior surface on each opposite side of said wide open mouth and on said extending lever portions beyond an inserted arrow shaft, said extending lever portions move inward toward one another tightly squeezing the convergent side walls against the arrow shaft, with the arrow shaft serving as a fulcrum for said extending lever portions, whereby substantially increased squeezing and thus gripping of an arrow shaft by said gripper member is provided beyond the hand applied squeezing pressure against said exterior surface of said gripper member.

2. A method of gripping and squeezing an arrow shaft for gaining squeezing pressure and gripping strength against the arrow shaft, for pulling the arrow shaft from a target by hand utilizing a gripper member having an elongated body including side walls defining a deep lengthwise groove having a mouth opening on one side of the body and a closed bottom end within said groove adjacent an opposite side of said body from said mouth opening, comprising the steps of:

(a) aligning the length of said groove parallel to the length of the arrow shaft;

(b) placing said gripper member and said groove over the arrow shaft with the arrow shaft positioned lengthwise between said side walls within said groove;

(c) locating the arrow shaft deeply within said groove so that portions of the side walls defining the groove on opposite sides of the arrow shaft extend substantially beyond the arrow shaft toward the mouth opening of the groove;

(d) squeezing the gripper member inward by hand;

(e) applying pressure while squeezing by hand on backsides of the portions of the side walls extending beyond the arrow shaft so that the extending wall portions move inward toward one another utilizing the arrow shaft as a fulcrum; and, (f) pulling on the gripper member away from the target while squeezing the gripper member inward onto the arrow shaft to grip the arrow shaft and to pull the arrow from the target.

3. A gripper member providing leveraged squeezing pressure gain over hand applied squeezing pressure against said gripper member for use in gripping an arrow shaft of an arrow during pulling of the arrow from a target, said gripper member comprising:

a main body comprised of relatively stiff rubbery material and sized sufficiently to be held in a human held with the main body pressed against the palm of the hand and the fingers and thumb of the hand wrapped about the main body to allow grasping and inward squeezing of the main body by the hand, said main body having an exterior surface for grasping and squeezing against by a human hand;

a deep longitudinal groove within said main body defined by a first and a second convergent side wall each facing one another and each having frictionally adhesive qualities for gripping an arrow shaft;

said groove extending from a first terminal end of said main body through said main body and through a second terminal end of said main body;

a wide open mouth opening into said groove through said exterior surface of said main body;

said mouth opening sufficiently wide for accepting an arrow shaft lengthwise aligned with said groove;

a narrow closed bottom end within said groove defined by a hinge portion of said exterior surface;

said hinge portion defined by flexible and resilient material connecting the convergent side walls to one another and serving to hold said groove and said mouth opening normally open, and allowing the convergent side walls to be brought inward toward one another with sufficient hand applied squeezing pressure;

said groove of sufficient depth between said mouth opening and said hinge portion to allow for placing an arrow shaft within said groove with the arrow shaft positioned sufficiently deep within said groove to be near said hinge portion and away from said mouth opening so as to leave extending lever portions of the convergent side walls outward beyond the arrow shaft toward said mouth opening;

said extending portions of the convergent side walls having a sufficient degree of stiffness operable in combination with the width of said mouth opening so that upon squeezing of said main body by hand with pressure applied to said exterior surface on each opposite side of said mouth opening on said extending lever portions beyond an arrow shaft within said groove, said extending portions move inward toward one another from the arrow shaft serving as a fulcrum to tightly squeeze the convergent side walls against the arrow shaft, whereby substantially increased squeezing and thus gripping of the arrow shaft by said gripper member is provided over the hand applied squeezing pressure.

* * * * *